United States Patent [19]

Lopez et al.

[11] Patent Number: 4,824,821

[45] **Date of Patent: * Apr. 25, 1989**

[54] DISPERSED GROUP VIB METAL SULFIDE CATALYST PROMOTED WITH GROUP VIII METAL

[75] Inventors: Jaime Lopez, Benicia, Calif.; Eugene A. Pasek, Export, Pa.

[73] Assignee: Chevron Research Company, San Francisco, Calif.

[ * ] Notice: The portion of the term of this patent subsequent to Dec. 1, 2004 has been disclaimed.

[21] Appl. No.: 767,760

[22] Filed: Aug. 21, 1985

Related U.S. Application Data

[63] Continuation-in-part of Ser. No. 527,414, Aug. 29, 1983, Pat. No. 4,557,821.

[51] Int. Cl.[4] ..... B01J 27/047; B01J 27/051

[52] U.S. Cl. ..... 502/220; 502/221

[58] Field of Search ..... 502/219, 220, 221

[56] References Cited

U.S. PATENT DOCUMENTS 4,243,553 1/1981 Naumann et al. ..... 502/220
4,243,554 1/1981 Naumann et al. ..... 502/220
4,285,804 8/1981 Jacquin et al. ..... 208/48 R
4,431,747 1/1984 Seiver et al. ..... 502/220
4,514,517 4/1985 Ho et al. ..... 502/220
4,710,486 12/1987 Lopez et al. ..... 502/219

*Primary Examiner*—Olik Chaudhuri
*Attorney, Agent, or Firm*—S. R. La Paglia; Q. Todd Dickinson

[57] ABSTRACT

A process for the preparation of a dispersed Group VIB metal sulfide catalyst which is promoted with a Group VIII metal for use in hydrocarbon oil hydroprocessing comprising dissolving a Group VIB metal compound, such as molybdenum oxide or tungsten oxide, with ammonia to form a water soluble compound such as aqueous ammonium molybdate or ammonium tungstate. The aqueous ammonium molybdate or ammonium tungstate is sulfided in a plurality of sulfiding steps at increasing temperatures. A compound containing a Group VIII metal is added to any sulfiding step in preference to the Group VIB metal dissolving step. The catalyst slurry and feed oil can then be passed to a hydroprocessing reactor.

32 Claims, 2 Drawing Sheets

DISPERSED GROUP VIB METAL SULFIDE CATALYST PROMOTED WITH GROUP VIII METAL

This application is a continuation-in-part of Ser. No. 527,414, filed Aug. 29, 1983, by J. Lopez, J. D. McKinney and E. A. Pasek, now U.S. Pat. No. 4,557,821.

This invention relates to the catalytic hydroprocessing of heavy hydrocarbon oils including crude oils, heavy crude oils and residual oils as well as refractory heavy distillates, such as FCC decanted oils and lubricating oils. It also relates to the hydroprocessing of shale oils, oils from tar sands, and coal liquids.

The present invention also relates to the preparation of a slurry hydrogenation catalyst for said catalytic hydroprocessing of hydrocarbon oils. The catalyst of the present invention is an unsupported circulating sulfided Group VIB metal slurry catalyst, specifically a molybdenum sulfide or tungsten sulfide catalyst, which is promoted with a Group VIII metal, such as nickel or cobalt. The circulating nature of the slurry catalyst of this invention is conducive to the employment of elevated process temperatures. In contrast, elevated temperatures would be impractical in a fixed bed system. The employment of high process temperatures in conjunction with a fixed bed catalyst induces progressive coke accumulation on the catalyst leading to a catalyst aging problem. In contrast, with a slurry catalyst, catalyst rejuvenation can be very rapid since fresh or regenerated catalyst can be continuously introduced to the system while used catalyst can be continuously regenerated or removed from the system so that there is no catalyst aging problem.

The particles of the slurry catalyst of this invention exist as a substantially homogeneous dispersion first in water, then in an oil or water/oil mixture of small particles made up of extremely small crystallites. Catalyst activity is dependent on the smallness of particle size as well as on pore characteristics. Although the present catalyst does have pores and there is some reactant migration into said pores, significant activity probably exists at the exterior of the catalyst. The catalyst can comprise molybdenum disulfide which is probably structured molecularly as basal platelets of molybendum atoms separated by two layers of sulfur atoms with activity sites concentrated at the edge of each basal plane of molybdenum atoms.

We have found that slurry catalysts prepared from Group VIB metals can have a substantially enhanced hydrogenation activity as well as an enhanced desulfurization and denitrogenation activity when promoted as described herein with at least one Group VIII metal, such as nickel or cobalt. The Group VIII metal can be added to the Group VIB slurry catalyst in any convenient form, e.g., as water soluble inorganic salts or as organometallic compounds. The weight ratio of Group VIII metal to Group VIB metal can be 0.001 to 0.75, generally; 0.01 to 0.03, preferably; and 0.08 to 0.20, most preferably. Examples of suitable water soluble inorganic salts of Group VIII metals are sulfates, nitrates, etc. Examples of suitable organometallic compounds of Group VIII metals include naphthenates, porphyrins, etc.

Suitable Group VIB metals include molybdenum and tungsten. The Group VIB metal slurry catalyst is prepared by dissolving a soluble compound, such as an oxygen-containing ammonium compound, of molybdenum or tungsten in water, followed by sulfiding the soluble ammonium oxygen-containing metal compound in a plurality of sulfiding steps of increasing temperature to replace the oxygen with sulfur and to form an aqueous slurry of solids. After adequate sulfiding in an aqueous phase, the slurry is mixed with fuel oil to form a water/oil system and sulfiding is continued.

The Group VIII metal solution or compound is not added to the soluble molybdenum or tungsten compound in advance of the beginning of sulfiding, i.e., the Group VIII metal is not added until at least the beginning of thiosubstitution or until after thiosubstitution begins. If ammonia is removed between thiosubstitution steps, the Group VIII metal can be added either before or after ammonia removal. The finished catalyst exhibits an improved hydrogenation activity when the Group VIII metal is added coincidently with the beginning of thiosubstitution or after thiosubstitution begins, as contrasted to adding the Group VIII metal to aqueous ammonium molybdate or aqueous ammonium tungstate solution in advance of any thiosubstitution. In sharp contrast, it was shown in U.S. Pat. No. 4,557,821, filed Apr. 29, 1983, which is hereby incorporated by reference, that addition of the Group VIII salt to a Group VIB slurry catalyst in advance of thiosubstitution of a soluble salt resulted in a finished catalyst of decreased, rather than improved, hydrogenation activity (see Table XIII of Pat. No. 4,557,821).

The Group VIII metal promoted catalyst of the present invention comprises dispersed particles of a highly active form of a Group VIB metal sulfide, such as molybdenum disulfide. To prepare the catalyst, an aqueous slurry of molybdenum oxide ($MoO_3$) or tungsten oxide ($WO_3$) is reacted with aqueous ammonia to dissolve the molybdenum or tungsten as ammonium molybdates or ammonium tungstates. The ammonium molybdates or ammonium tungstates are then sulfided with a sulfiding agent. The sulfiding causes thiosubstituted molybdenum particles to form. The sulfiding can occur in a plurality of zones of increasing temperature. Whatever mode of sulfiding is employed, it is important that the Group VIII metal, whether it be in the form of an aqueous salt solution or an organometallic compound, is not added until sulfiding is underway and preferably after some sulfiding has already occurred. Preferred methods of sulfiding are described herein. According to these preferred sulfiding methods, the initial sulfiding step or steps occurs in the aqueous phase in the substantial absence of feed oil. A final sulfiding step occurs in the presence of feed oil. Because the initial sulfiding of the Group VIB metal occurs in an aqueous non-oleagenous phase, ammonia can be separated from the system after the final aqueous non-oleagenous phase sulfiding step and before addition of feed oil. In this case, the Group VIII metal can be added either before or after the ammonia separation step.

Molybdenum sulfide is the preferred Group VIB metal sulfide. Nickel is the preferred Group VIII metal. The final catalyst can comprise small particles made up of crystallites of $MoS_2$ promoted with nickel, although the atomic ratio of sulfur to molybdenum is frequently not 2 or is only approximately 2. If the catalyst is non-promoted $MoS_2$, it is an exceptionally active form of $MoS_2$ and promotion thereof with Group VIII metal renders it even more active. Group VIII metal promotion can be practiced upon slurry $MoS_2$ catalyst prepared by various methods. For example, Ser. No. 527,414, mentioned above, taught the presence of feed oil during most of the stages of multistage sulfiding of the precursor ammonium molybdate to $MoS_2$, and did not teach ammonia removal during catalyst preparation.

Although not to be bound by any theory, sulfiding of the aqueous soluble ammonium molybdate induces formation of dispersed particles of ammonium molybdenum oxysulfide and then molybdenum oxysulfide. After a sufficient degree of sulfiding occurs, the molybdenum oxysulfide can be mixed with all or a portion of the feed oil stream using the dispersal power of a hydrogen-hydrogen sulfide stream and the admixture then is passed through a final sulfiding zone. The final sulfiding zone can also serve as a hydroprocessing zone or can be followed by a separate higher temperature hydroprocessing zone. Each sulfiding and hydroprocessing zone in the sequence is operated at a temperature higher than its predecessor. The Group VIII metal salt or organometallic compound is first added to the system at one of the sulfiding stages and is not added at the stage where the soluble ammonium molybdates or ammonium tungstates are being formed.

The residence time in each sulfiding zone can be, for example, 0.02 to 0.5 hours, or more. The various sulfiding zones can employ the same or different residence times. For example, a residence time of 2 hours, or more, may be useful in the high temperature sulfiding reactor. In general, the residence time in each sulfiding zone can be at least 0.02, 0.05, 0.1 or 0.2 hours. The residence time in each zone can be at least 0.3, 0.4 or 0.5 hours. Each sulfiding zone is constituted by a time-temperature relationship and any single reactor can constitute one or more sulfiding zones depending upon whether the stream is heated or is at a constant temperature in the reactor and upon the duration of the stream time within a particular temperature range during stream residence in the reactor.

If the initial sulfiding is performed in an aqueous, non-oleaginous environment, the sulfiding of the catalyst is performed in at least two steps or, preferably, in three steps. The first sulfiding step or stage is operated at a relatively low temperature with an aqueous phase and without feed oil. If three sulfiding stages are employed, the second sulfiding stage is operated at an intermediate temperature which is higher than the temperature of the low temperature stage with an aqueous phase substantially with or without feed oil. The third stage is a high temperature stage operated at a temperature which is higher than the temperature of the intermediate temperature stage. Ammonia can be separated from the aqueous stream flowing from the intermediate temperature stage, leaving a separator residue. If oil is added to the intermediate temperature stage, ammonia can be separated from the aqueous stream flowing from the low temperature stage. In either case, the separator residue from the ammonia separation is passed to the next higher temperature stage together with feed oil. The Group VIII metal is first added to the system at any of the sulfiding stages. It can be added to a sulfiding stage before or after the ammonia separation step, but preferably after the ammonia separation step.

If only two sulfiding steps are employed, the low and intermediate temperature stages can be combined into a single aqueous stage operated substantially without feed oil. The sulfiding reactions in the low and intermediate temperature stages generate ammonia from gradual decomposition of ammonium molybdates or ammonium tungstrates. If no oil is present, this ammonia can be removed from the effluent stream leaving the combined stage and oil is added to the separator residue entering the high temperature sulfiding stage. Again, the Group VIII metal can be added to a sulfiding stage before or after the ammonia separation step.

The ammonia removal step has a favorable effect upon catalyst activity because ammonia is a depressant to the activity of a hydrogenation catalyst. Ammonia removal is beneficial to catalyst activity because any ammonia present can be adsorbed at metal sites and constitute a catalyst poison. Ammonia is easily separable from a substantially oil-free aqueous phase effluent from the low and intermediate temperature sulfiding stages by cooling and depressurizing the slurry stream. If oil were present, the stream would have to be heated prior to depressurization and ammonia vaporization. A simple aqueous phase ammonia flashing step would become a highly expensive flashing operation if an oil phase were present.

The catalyst preparation mode in which feed oil is first added at the high temperature sulfiding stage permits the process to employ as a feed oil a hot refractory oil stream flowing from an adjacent refinery at an elevated temperature without necessitating a cooling step. For example, a vacuum tower bottoms stream may be available from a refinery at a temperature of about 550° F. Since this temperature is below the temperature of the relatively high temperature sulfiding zone of the present invention, the stream can be directly charged thereto without prior cooling. However, since this temperature is above the temperature of the relatively low temperature sulfiding zone and is also likely to be above the temperature of the intermediate temperature sulfiding zone, if this hot oil stream were to be charged to either of those zones it would first have to be cooled.

In a more detailed descripion of the present invention, a dispersed nickel promoted molybdenum sulfide hydrocarbon oil hydroprocessing catalyst can be prepared by reacting ammonia and a molybdenum compound, such as $MoO_3$, in slurry with water to produce aqueous ammonium molybdates. Although the $MoO_3$ is insoluble in water, the ammonium molybdates are soluble. The nickel compound is not added at this stage. If the nickel compound were added at this stage, it would inhibit rather than improve the hydrogenation activity of the catalyst. The ammonium molybdates are then sulfided with hydrogen sulfide, with or without hydrogen, in a relatively low temperature reactor and in the substantial absence of feed oil. The sulfiding reaction is continued in an intermediate temperature reactor, at a temperature above the temperature of the low temperature reactor with or without feed oil. An aqueous solution of nickel sulfate can be added to either the low or intermediate temperature sulfiding reactor.

When the intermediate temperature sulfiding is performed in the absence of feed oil, an aqueous effluent stream is withdrawn from the intermediate temperature sulfiding reactor. The stream is cooled, depressurized and passed to a separator zone to allow ammonia to be flashed off together with unreacted hydrogen sulfide and hydrogen. Ammonia can be scrubbed from the flashed gases and removed from or reused in the system. The ammonia scrubbed hydrogen and hydrogen sulfide can be recycled. Flash residue from the aqueous effluent stream is mixed with feed oil for the first time and is passed together with hydrogen sulfide and hydrogen to a high temperature sulfiding reactor maintained at a temperature above the temperature in the intermediate temperature sulfiding reactor. If desired, the aqueous solution of nickel sulfate can be added to the high temperature sulfiding reactor. A water-oil slurry containing dispersed molybdenum disulfide slurry catalyst is produced in the high temperature sulfiding reactor.

If the temperature in the high temperature sulfiding reactor is sufficiently high for hydroprocessing the feed oil, the residence time in the high temperature reactor can be sufficient to accomplish both the high temperature sulfiding and the required hydroprocessing reactions. If a higher temperature is required to accomplish hydroprocessing of the feed oil, the effluent stream from the high temperature reactor is passed to a hydroprocessing reactor operated at a hydroprocessing temperature which is higher than the temperature in the high temperature sulfiding reactor.

Although not to be bound by any theory, it is believed that the following reactions occur in the various catalyst preparation steps. In the first catalyst preparation step, insoluble, crystalline $MoO_3$ is mixed with water to form a non-oleaginous slurry which is reacted with ammonia to form soluble ammonium heptamolybdate and other ammonium molybdates. As an example consider the following generalized equation for the formulation of ammonium heptamolybdate:

$$\underset{\text{Insoluble Crystalline}}{7\,MoO_3} + 6\,NH_3 + 3\,H_2O \longrightarrow \underset{\text{Soluble}}{(NH_4)_6Mo_7O_{24}}$$

The $MoO_3$ can be dissolved under the following conditions:

| | |
|---|---|
| $NH_3$/Mo Weight Ratio | 0.1 to 0.6; preferably 0.15 to 0.3 |
| Temperature, °F. | 33 to 350; preferably 120 to 180 |
| Pressure: psig | 0 to 400; preferably 0 to 10 |

The pressure and temperature are not critical. Increased pressure is required to maintain the ammonia in aqueous solution at elevated temperatures. Elevated temperature is necessary to insure reaction and vary the concentration of molybdenum dissolved in the solution. The Group VIII metal is not added to the system in this precursor stage. If it were, it would impart diminished hydrogenation activity to the catalyst. This is demonstrated in Table XIII of U.S. Pat. No. 4,557,821, which demonstration is incorporated by reference.

The solution of ammonium molybdates is passed to a series of sulfiding reactors, stages or steps operated at ascending temperatures. It is first passed to a relatively low temperature sulfiding reactor where it is contacted with gaseous hydrogen sulfide, preferably a hydrogen/-hydrogen sulfide blend with or without feed oil, but preferably in the absence of oil. The generalized sulfiding reaction is as follows:

$$(NH_4)_6Mo_7O_{24} + H_2S \longrightarrow \underset{\text{amorphous}}{(NH_4)_xMoO_yS_z}$$

The above is a generalized equation using ammonium heptamolybdate as a starting material. The reaction products in the low temperature sulfiding reactor include ammonium molybdates, ammonium molybdenum oxysulfides and possibly molybdenum sulfides. The Group VIII metal can be added to this or any subsequent sulfiding stage.

The following can be the conditions in the low temperature sulfiding reactor:

| | |
|---|---|
| $H_2S$:SCF/Mo:lbs Ratio | above 2.7; preferably above 12 |
| Temperature, °F. | 70 to 350; preferably 130 to 180 |
| Hydrogen sulfide partial pressure, psi | 3 to 400; preferably 150 to 250 |

It is important not to exceed the above temperature range in the low temperature reactor. At temperatures above 350° F. ammonia loss from the catalyst will occur faster than thiosubstitution can proceed and the molybdenum compound formed, a lower ammonium entity, will precipitate and possibly plug the reactor.

It is possible to operate the low temperature sulfiding reactor at a temperature below 325° or 350° F. for a relatively long duration to allow the thiosubstitution reaction to proceed faster than ammonia loss so that a molybdenum compound will not precipitate. If the duration in the low temperature reactor is sufficiently long, the intermediate temperature reactor described below can be omitted and in the non-oleogenous mode the effluent from the low temperature reactor can be passed through an ammonia separator and then directly to a high temperature reactor.

The effluent stream from the low temperature reactor is passed to an intermediate temperature reactor, which can contain oil or, preferably, can be aqueous and substantially non-oleaginous. The intermediate temperature reactor can be operated under the following conditions:

| | |
|---|---|
| Temperature, °F. | 180 to 700; preferably 300 to 550 |
| Hydrogen sulfide Partial pressure, psi | 3 to 440; preferably 150 to 250 |

The temperature in the intermediate temperature reactor is higher than the temperature in the low temperature reactor. If it is desired to employ the same temperatures in both reactors, the intermediate temperature reactor can be dispensed with and the low temperature reactor can be operated for a longer time. The time required will be sufficient to accomplish sulfiding of the molybdenum compound and dispersion of the sulfided particles before ammonia loss can occur with precipitation of the molybdenum compound.

The following generalized reaction can occur in the intermediate temperature reactor:

$$(NH_4)_xMoO_yS_z + H_2S \longrightarrow Mo_{x'}S_{y'} + NH_3$$

where x' is about 1 y' is about 2

The Group VIII metal compound can be added to the intermediate temperature reactor. The molybdenum compound in the intermediate temperature reactor is sufficiently sulfided so that upon loss of ammonia it is in a particulate form which is sufficiently fine that it can remain dispersed with sufficient agitation. In addition, the molybdenum compound is sufficiently sulfided that a crystalline structure is evolving from the amorphous form it exhibited in the low temperature sulfiding reactor. If the ammonia generated from the ammonium molybdenum oxysulfide compound in the intermediate temperature reactor is not removed, it may tend to inhibit the activity of the molybdenum catalyst in a subsequent hydrocarbon oil hydroprocessing reactor.

The effluents from the low and the intermediate temperature reactors comprise a finely dispersed aqueous slurry catalyst precursor together with ammonia, hydrogen and hydrogen sulfide. If oil has not been added, either of these slurries can be cooled and depressurized to separate and remove ammonia and, incidently, hydrogen and hydrogen sulfide. Flash conditions, including temperature and pressure, are selected so that most of the ammonia derived from the decomposition of the ammonium molybdenum oxysulfides and any excess ammonia used in forming ammonium molybdate during the dissolution of molybdenum oxide can be removed from the system. Flash conditions are controlled so as to maximize removal of ammonia while retarding water vaporization and loss. Adequate water retention is required to maintain the catalyst as a slurry which is sufficiently fluid to permit pumping and to accomplish dispersion of the catalyst in the feed oil which is added later.

If an ammonia separation step is desired, the slurry should not be admixed with feed oil until after the ammonia separation step. The reason is that ammonia is significantly more difficult to remove from oil than from water. Therefore, feed oil is admixed with the catalyst slurry for the first time after the ammonia is separated from the catalyst slurry. Hydrogen sulfide and hydrogen are also introduced to the slurry together with the feed oil. The Group VIII metal can be introduced to the slurry after the ammonia separation step. In this mode, when the oil is added the molybdenum compound is no longer a soluble ammonium salt, but rather is dispersed solid molybdenum oxysulfide. The molybdenum compound requires further conversion to the molybdenum sulfide active catalyst state in the presence of oil at a temperature in the range 500° to 750° F., generally, or in the range of 550° to 725° F., preferably, which is above the temperature of the intermediate temperature sulfiding reactor. This further reaction occurs in a high temperature sulfiding reactor in the presence of an oil/water phase and may be expressed by the following reaction:

$$MoO_xS_y \xrightarrow{H_2,\ H_2S} \underset{\text{Highly Active}}{MoS_2} + H_2O$$

where x is about 1 y is about 2

The high temperature reactor operated at a temperature in the range 500° to 750° F. can also be employed as the hydroprocessing reactor if the feed oil is capable of being hydroprocessed at a temperature of 750° F., or below. However, feed oils commonly require hydroprocessing temperatures above 750° F., e.g. above 800° F., or at least a temperature above the temperature in the high temperature sulfiding reactor. In general, the temperature in the hydroprocessing reactor is 650° to 950° F.

If high hydroprocessing temperatures are required, it is important to employ as separate zones a high temperature sulfiding reactor and a hydroprocessing reactor. If the catalyst precursor leaving the intermediate temperature reactor is passed together with feed oil and hydrogen sulfide directly to a hydroprocessing reactor operated at a temperature above the temperature of the high temperature sulfiding reactor, such as 800° F., or above, in the presence of water, the molybdenum compound loses, rather than gains, sulfur to form an inactive catalyst according to the following reaction:

$$MoO_xS_y + H_2O \xrightarrow{800°\ F.} \underset{\text{Inactive Catalyst}}{MoO_{x'}S_{y'}} + H_2S \text{ or } \underset{\text{Mixtures}}{(MoO_2/MoS_2 + H_2S)}$$

where y' is less than 2. The product is not a sufficiently active catalyst to inhibit coking reactions.

It is important to note that the $MoO_xS_y$ (where x is about 1, y is about 2) in the presence of hydrogen sulfide and water reacts preferentially with the hydrogen sulfide to become sulfided at a lower temperature,i.e., between 500° and 750° F. It has been found that the $MoS_2$ catalyst formed in the temperature range 500° to 750° F. is a low coking catalyst. However, at a temperature above this range, the $MoO_xS_y$ (where x is about 1 and y is about 2) in the presence of hydrogen sulfide and water reacts preferentially with the water to form $MoO_{x'}S_{y'}$ (where y' is less than 2), which is inactive.

As indicated above, the high temperature sulfiding reactor operated at a temperature between 500° and 750° F. can perform as both a catalyst sulfiding reactor and a feed oil hydroprocessing reactor if the feed oil is capable of being hydroprocessed at a temperature within this range. However, if a higher hydroprocessing temperature is required, the conversion of the catalyst to molybdenum disulfide will have to be completed in a high temperature sulfiding reactor having a temperature within the range 500° to 750° F., after which the slurry can be passed to a higher temperature hydroprocessing reactor.

It will be appreciated that the low, intermediate and high temperature sulfiding zones, stages or steps described herein can constitute separate reactors, as illustrated, or some or all of these zones, stages or steps can be merged into a single reactor. In terms of concept, each of these sulfiding zones, stages or steps is represented by a residence time-temperature relationship. If the stream is heated through the temperature range indicated above for any sulfiding zone, stage or step for the time duration indicated above, then the performance of the process requirements to satisfy that zone, stage or step has occurred.

The total pressure in the sulfiding reactors and in the hydroprocessing reactor can be 500 to 5,000 psi.

The catalyst preparation method described above uses $MoO_3$ as a starting material for preparing the catalyst precursor. However, other molybdenum compounds are also useful as starting materials. For example, thiosubstituted ammonium molybdates, including ammonium oxythiomolybdates, such as ammonium oxymonothiomolybdate, ammonium oxydithiomolybdate, ammomium oxytrithiomolybdate or ammonium oxytetrathiomolybdate can be employed. Since these materials are produced from $MoO_3$ in the first two catalyst preparation steps described above, i.e. the reaction of $MoO_3$ with ammonia step and the low temperature sulfiding step, these two steps can be bypassed by employing these thiosubstituted compounds as starting materials. Therefore, when these thiosubstituted compounds are used as catalyst precursors a water slurry thereof can be injected with hydrogen sulfide, hydrogen and a Group VIII metal and passed directly to the intermediate temperature sulfiding reactor described above, followed preferentially by separation of ammonia and then the high temperature sulfiding reactor and the hydroprocessing reactor, as described above. Also, as described above, the Group VIII metal can be added to the high temperature sulfiding reactor after the ammonia separation step instead of to the intermediate temperature reactor in advance of the ammonia separation step.

The embodiment of the present invention which relates to a method for the preparation of a dispersed tungsten sulfide hydrocarbon oil hydroprocessing catalyst is essentially analogous to the molybdenum sulfide catalyst preparation method described above. In the first stage, a tungsten salt, such as $WO_3$, is slurried in water and reacted with ammonia to form water soluble ammonium tungstate. The ammonium tungstate is then sulfided in the same sequence in ascending temperature sulfiding reactors with a similar ammonia separation step, as described for the molybdenum catalyst preparation sequence.

In the first stage, the reaction is as follows:

$$WO_3 + NH_3 + H_2O \longrightarrow \text{Soluble Ammonium Tungstate}$$

Insoluble

The Group VIII metal should not be added to the first stage.

The following reaction occurs in the low temperature sulfiding reactor:

$$\text{Soluble Ammonium Tungstate} + H_2S \longrightarrow (NH_4)_xWO_ySz$$

The Group VIII metal can be added to the low temperature sulfiding reactor or to any subsequent sulfiding reactor.

As described above in regard to the ammonium thiomolybdates, ammonium thiotungstates can be employed as starting materials, in which case the above two steps can be bypassed. Suitable starting materials include ammonium oxythiotungstates such as ammonium oxymonothiotungstate, ammonium oxydithiotungstate, ammonium oxytrithiotungstate or ammonium oxytetrathiotungstate.

The reaction occurring in the intermediate temperature sulfiding reactor is:

$$(NH_4)_xWO_ySz + H_2S \longrightarrow WO_{x'}S_{y'} + NH_3$$

where x' is about 1 y' is about 2

Finally, the reaction occurring in the high temperature sulfiding reactor is:

$$WO_xS_y \longrightarrow WS_2 + H_2O$$

where x is about 1 y is about 2

If desired, the method of the present invention can employ a combination $MoS_2$—$WS_2$ catalyst promoted with a Group VIII metal.

The following examples will illustrate the catalyst preparation method of this invention.

DETAILED DESCRIPTION OF THE INVENTION

EXAMPLE 1

A non-Group VIII metal promoted molybdenum catalyst was prepared according to the following steps:

(1) 937.9 g of molybdenum oxide (molybdenum trioxide) (Climax Molybdenum Grade L) was added to 5979.2 g of distilled water to form an aqueous slurry. To this slurry, 653.8 g of ammonium hydroxide solution (23.2 percent by weight ammonia) was added with mixing. Following are the conditions of this step.

| | |
|---|---|
| $NH_3$/Mo ratio: Weight | 0.2342 |
| Temperature, °F.: | 150. |
| Pressure, psig: | atmospheric |
| Time, hrs. | 2.0 |

(2) The solution from step (1) was charged to a reactor, where a flow of a hydrogen sulfide containing gas (92% hydrogen, 8% hydrogen sulfide) was introduced. The conditions were as follows:

| | |
|---|---|
| Temperature, °F. | 150. |
| Pressure, psig: | 35.0 |
| $H_2S$ partial pressure, psi: | 3.2 |
| $H_2S$/molybdenum ratio | 2.7 SCF/lb |

At the end this step, the flow of hydrogen sulfide was stopped, the product was cooled and the resulting slurry was pumped from the reactor.

Figure 2:
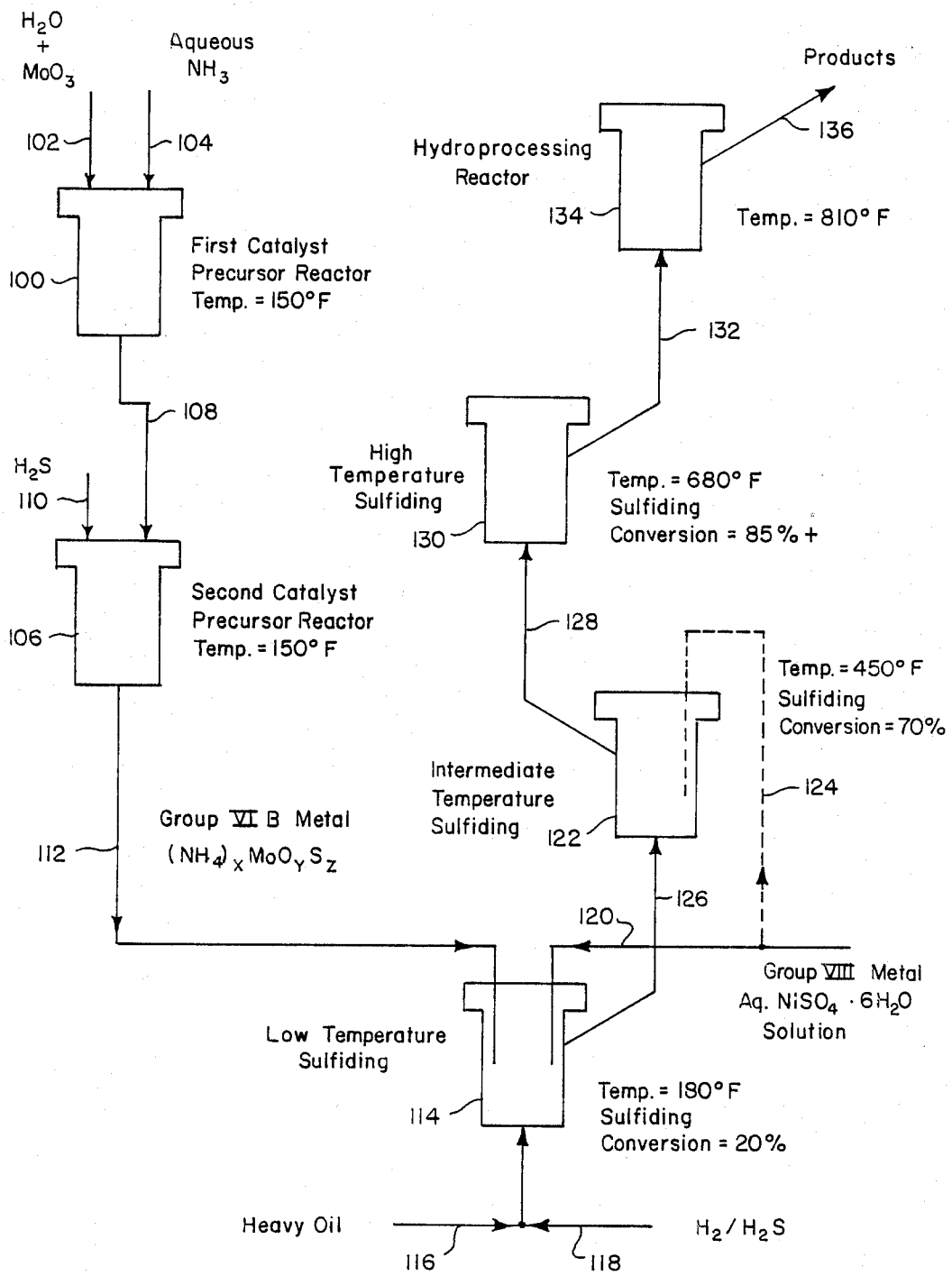

This resulting slurry comprising ammonium molybdenum oxysulfides ($(NH_4)_xMoO_ySz$) was introduced to a continuous slurry unit where it was dispersed with a stream of heavy oil and recycle gas containing hydrogen and hydrogen sulfide. The heavy oil consisted of a vacuum reduced crude obtained from a crude mixture of West Texas/Garupa Crude whose inspections are shown in Table I. The oil-water mixture was then subjected to sulfiding at low, intermediate and high sulfiding temperatures and then to hydroprocessing, at the conditions set forth in Table II. A schematic representation of the catalyst preparation and reactor zones of this example, disregarding process conditions and except that nickel sulfate was not added in this example, is shown in FIG. 2.

EXAMPLE 2

The test of Example 1 was repeated. However, this time 19.7 weight percent nickel sulfate ($NiSo_46H_2O$) solution in water was pumped to the low temperature sulfiding step as indicated in FIG. 2. The operating conditions are shown in Table II.

EXAMPLE 3

The test of Example 2 was repeated except that the nickel sulfate solution was increased to 34.6 weight percent nickel sulfate ($NiS0_4.6H_2O$) solution in water and pumped to the same place in the unit at the same rate. The operating conditions are shown in Table II.

The results of Examples 1, 2 and 3 are shown in Table II. The results shown in Table II include hydrogen consumption, desulfurization, denitrogenation and 775° F. minus product yield.

Table III shows inspections of the light oil product ($C_5$ to 550° F.), vacuum tower overhead heavy gas oil product (550° to 775° F.), the vacuum tower bottoms (775° F.+) and the coke plus recovered catalyst. Coke plus catalyst is defined as the vacuum tower bottoms THF (tetrahydrofuran) insolubles.

TABLE I

| GARUPA-WEST TEXAS SOUR VTB | |
|---|---|
| Inspections | |
| Gravity, API | 9.7 |
| Specific Gravity | 1.0021 |
| Sulfur, wt % | 2.52 |
| Carbon, wt % | 85.53 |
| Hydrogen, wt % | 10.76 |
| Nitrogen, wt % | 0.55 |
| Oxygen, wt % | 0.44 |
| Nickel, ppm | 20 |
| Vanadium, ppm | 35 |
| Carbon Residue, Con., wt % | 16.0 |
| Viscosity, SUS, D2161 | |
| 210° F.: | 3631 |
| 300° F.: | 347 |
| Hydrocarbon Type, wt % | |
| Saturates | 20.4 |
| Aromatics | 48.9 |
| Polar Compounds | 24.8 |
| Insolubles | 5.9 |
| Distillation, D1160, vac., °F. | |
| E.P. — | |
| 5% @ | 837 |
| 10% @ | 894 |
| 20% @ | cracked @ 8% |
| 30% @ | — |

TABLE II

| | EXAMPLE | | |
|---|---|---|---|
| | #1 | #2 | #3 |
| FEEDSTOCK | Garupa-West Texas VTB | | |
| CATALYST TO OIL RATIO | | | |
| Molybdenum: wt/wt | 0.0148 | 0.0151 | 0.0153 |
| Nickel: wt/wt | — | 0.0013 | 0.0023 |
| Water/Oil Ratio: wt/wt | 0.1663 | 0.1701 | 0.1725 |
| OPERATING CONDITIONS | | | |
| LHSV: vol/hr/vol | | | |
| Low temperature sulfiding | 2.036 | 1.988 | 2.031 |
| Intermediate temperature sulfiding | 2.036 | 1.988 | 2.031 |
| High temperature sulfiding | 2.036 | 1.988 | 2.031 |
| Reactor | 0.599 | 0.585 | 0.597 |
| TEMPERATURE: °F. | | | |
| Low temperature sulfiding | 227. | 181. | 181. |
| Intermediate temperature sulfiding | 448. | 446. | 445. |
| High temperature sulfiding | 680. | 684. | 680. |
| Reactor | 810. | 816. | 817. |
| HYDROGEN PARTIAL PRESSURE: psi | | | |
| Sulfiding | 2254.1 | 2228.8 | 2235.1 |
| Reactor Average | 1565.3 | 1507.4 | 1493.4 |
| HYDROGEN SULFIDE PARTIAL PRESSURE: psi | | | |
| Sulfiding | 177.8 | 187.4 | 175.3 |

TABLE II-continued

| | EXAMPLE | | |
|---|---|---|---|
| | #1 | #2 | #3 |
| Reactor Average | 148.9 | 162.0 | 154.4 |
| RECYCLE GAS | | | |
| Gas Rate: SCFB | 3876.5 | 3920.0 | 3847.9 |
| Hydrogen: mole % | 89.21 | 88.20 | 88.42 |
| Hydrogen Sulfide: mole % | 7.04 | 7.42 | 6.94 |
| CONVERSION | | | |
| HYDROGEN CONSUMPTION | | | |
| Unit: SCFB | 650. | 763. | 777. |
| Chemical: SCFB | 644. | 754. | 712. |
| % Desulfurization | 43.64 | 57.09 | 62.30 |
| % Denitrogenation | 11.61 | 15.14 | 20.08 |
| Conversion to 775° F.-: vol. % | 30.18 | 36.42 | 36.29 |
| Delta API | 10.76 | 13.97 | 12.91 |
| UNIT YIELDS | | | |
| Weight Yields: wt % | | | |
| Hydrogen | −0.97 | −1.13 | −1.07 |
| Hydrogen Sulfide | 1.17 | 1.53 | 1.67 |
| Ammonia | 0.08 | 0.10 | 0.13 |
| Cl-C2 | | | |
| Methane | 0.67 | 0.81 | 0.81 |
| Ethane | 0.59 | 0.70 | 0.70 |
| Ethylene | 0.00 | 0.00 | 0.00 |
| C3-C4 | | | |
| Propane | 0.83 | 0.94 | 0.95 |
| Propylene | 0.00 | 0.00 | 0.00 |
| i-Butane | 0.15 | 0.16 | 0.17 |
| n-Butane | 0.62 | 0.68 | 0.70 |
| Butene | 0.00 | 0.00 | 0.01 |
| Light Oil, C5-550° F. | 14.78 | 16.70 | 16.31 |
| Gas Oil, 550-775° F. | 7.36 | 10.26 | 10.58 |
| Vacuum Bottoms, 775° F.+ | 73.53 | 68.05 | 67.59 |
| Coke | 1.19 | 1.19 | 1.47 |
| Catalyst | 2.416 | 2.588 | 2.690 |
| Molybdenum | 1.477 | 1.509 | 1.503 |
| Sulfur | 0.934 | 0.937 | 0.909 |
| Nickel | 0.002 | 0.139 | 0.248 |
| Vanadium | 0.003 | 0.004 | 0.029 |
| Volume Yields: vol % | | | |
| C3-C4 | | | |
| Propane | 1.62 | 1.85 | 1.87 |
| Propylene | 0.00 | 0.01 | 0.00 |
| i-Butane | 0.27 | 0.29 | 0.29 |
| n-Butane | 1.06 | 1.17 | 1.20 |
| Butene | 0.00 | 0.00 | 0.02 |
| Light Oil, C5-550° F. | 18.90 | 21.45 | 20.90 |
| Gas Oil, 550-775° F. | 8.32 | 11.65 | 12.01 |
| Vacuum Bottoms, 775° F.+ | 74.51 | 69.96 | 68.81 |
| Total | 104.68 | 106.38 | 105.10 |

TABLE III

| FEEDSTOCK: | EXAMPLE | | |
|---|---|---|---|
| | #1 | #2 | #3 |
| CATALYST/OIL RATIO: | | | |
| Molybdenum: | .0148 | .0151 | .0153 |
| Nickel: | — | .0013 | .0023 |
| LIGHT OIL | | | |
| UNIT YIELD: wt % | 13.78 | 15.73 | 15.58 |
| INSPECTIONS: | | | |
| Gravity: API | 45.2 | 46.9 | 46.5 |
| Specific Gravity | .8008 | .7932 | .7949 |
| Carbon: wt % | 85.48 | 85.96 | 86.46 |
| Hydrogen: wt % | 13.46 | 13.76 | 13.75 |
| Nitrogen: wppm | 509 | 552 | 552 |
| Sulfur, X-ray: wt % | 0.543 | 0.234 | 0.183 |
| Bromine Number | 23 | 15.2 | 12.6 |
| Hydrocarbon Analysis | | | |
| FIA: vol % | | | |
| Aromatics | 19.5 | 18.5 | 23.0 |
| Olefins | 11.0 | 6.5 | 1.5 |
| Saturates | 69.5 | 75.0 | 75.5 |
| Paraffins | 38.1 | 42.1 | 43.3 |
| Naphthenes | 31.4 | 32.9 | 32.1 |

TABLE III-continued

| FEEDSTOCK: | EXAMPLE #1 | #2 | #3 |
|---|---|---|---|
| N + 2A | 70.4 | 69.9 | 78.1 |
| Distillation, simulated: °F. | | | |
| OP | 200 | 201 | 204 |
| 10% | 254 | 254 | 256 |
| 30% | 321 | 316 | 320 |
| 50% | 382 | 369 | 376 |
| 70% | 450 | 426 | 429 |
| 90% | 550 | 512 | 517 |
| EP | 653 | 612 | 614 |
| VACUUM TOWER OVERHEAD | | | |
| UNIT YIELD: wt % | 7.53 | 10.41 | 10.87 |
| INSPECTIONS: | | | |
| Gravity: API | 28.2 | 28.9 | 28.9 |
| Specific Gravity | .8860 | .8822 | .8822 |
| Carbon: wt % | 85.07 | 86.31 | 86.15 |
| Hydrogen: wt % | 12.15 | 12.48 | 12.52 |
| Nitrogen: wt % | 0.20 | 0.22 | 0.22 |
| Sulfur: wt % | 1.01 | 0.87 | 0.49 |
| Metals: | | | |
| Nickel: wppm | 2 | 0.2 | 2.3 |
| Molybdenum: wppm | 1 | 1.1 | 1 |
| Vanadium: wppm | 2 | 0.5 | 1 |
| Aniline Point: F | 143.4 | 144.3 | 147.9 |
| Carbon Residue: Rams: wt % | 0.15 | 0.15 | 0.14 |
| Distillation, simulated: F. | | | |
| 10% | 458 | 488 | 492 |
| 30% | 565 | 566 | 567 |
| 50% | 648 | 622 | 624 |
| 70% | 725 | 680 | 681 |
| 90% | 801 | 751 | 751 |
| VACUUM TOWER BOTTOMS | | | |
| UNIT YIELD: wt % | | | |
| Total Yield | 78.68 | 73.86 | 73.54 |
| THF Insolubles | 3.23 | 5.10 | 3.97 |
| Adjusted Yield | 75.45 | 68.76 | 69.57 |
| INSPECTIONS | | | |
| Gravity: API | 11.6 | 13.7 | 12.3 |
| Specified Gravity | 0.9890 | 0.9748 | 0.9843 |
| Carbon: wt % | 85.70 | 86.71 | 85.40 |
| Hydrogen: wt % | 10.66 | 10.63 | 10.52 |
| Nitrogen: wt % | 0.59 | 0.59 | 0.54 |
| Sulfur: wt % | 1.73 | 1.42 | 1.28 |
| Carbon Residue, Cons: wt % | 16.13 | 19.50 | 17.04 |
| THF INSOLUBLES (Coke + Catalyst) | | | |
| Carbon: wt % | 28.14 | 26.46 | 31.58 |
| Hydrogen: wt % | 3.27 | 2.47 | 3.40 |
| Nitrogen: wt % | 0.52 | 0.50 | 0.51 |
| Sulfur: wt % | 24.65 | 22.96 | 21.60 |
| Molybdenum: wt % | 39.00 | 37.00 | 35.70 |
| Nickel: wt % | 0.06 | 3.40 | 5.90 |

From these results, it is clear that a significant increase in hydrogenation activity as well as in desulfurization and denitrogenation activity was achieved by the addition of a nickel promoter to the molybdenum catalyst. The results of Table II show a significant increase in chemical hydrogen consumption as compared to a nickel-free catalyst. It is remarkable that either of the nickel-promoted catalysts achieved an improvement in hydrogenation activity because nickel promotion of the slurry catalyst of U.S. Pat. Ser. No. 527,414, wherein the nickel was introduced in advance of any sulfiding step, resulted in a loss of hydrogenation activity, even though much higher levels of nickel were employed than in the tests of the present invention.

Figure 1:
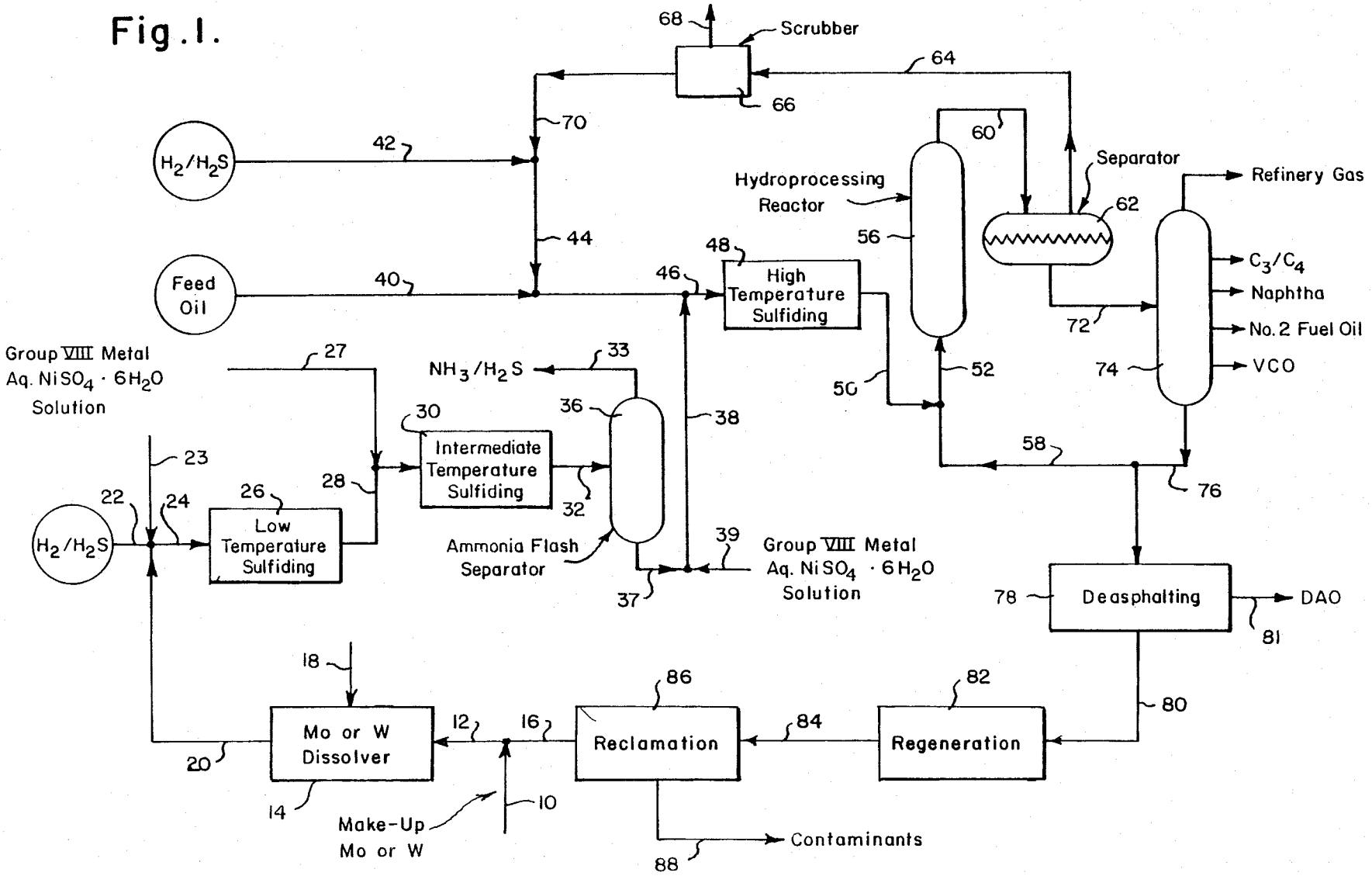
FIGS. 1 and 2 are schematic representations of the catalyst preparation and reactor zones of the present invention.

One mode of the process of this invention is illustrated in FIG. 1 wherein catalytic molybdenum or tungsten, in the form of water-insoluble $MoO_3$ or $WO_3$, is introduced through lines 10 and 12 to disssolver zone 14. Recycle molybdenum or tungsten, from a source described below, is introduced through line 16. Water and ammonia are added to dissolver zone 14 through line 18. Water insoluble molybdenum oxide or tungsten oxide is converted to water soluble ammonium molybdate salts or ammonium tungstate salts in dissolver zone 14.

Aqueous ammonium molybdates or ammonium tungstates containing excess ammonia is discharaged from zone 14 through line 20, admixed with hydrogen/hydrogen sulfide mixture entering through line 22 and then passed through line 24 to low temperature sulfiding zone 26. If desired, the Group VIII metal, e.g., in the form of aqueous nickel sulfate solution can be injected through line 23 to line 24. In low temperature sulfiding zone 26, ammonium molybdate or ammonium tungstate is converted to thiosubstituted ammonium molybdates, or thiosubstituted ammonium tungstates. The sulfiding temperature in zone 26 is sufficiently low that the ammonium salt is not decomposed while thiosubstitution is beginning. If the ammonium salt were decomposed in the early stages of thiosubstitution, an insoluble oxythiomolybdate, or a mixture of $MoO_3$ /$MoS_3$, or an insoluble oxythiotungstate, or a mixture of $W0_3$ and $WS_3$, would precipitate out in zone 26 and possibly plug zone 26.

An effluent stream from low temperature sulfiding zone 26 is passed through line 28 to intermediate temperature sulfiding zone 30. If desired, the Group VIII metal, e.g., in the form of an aqueous $NiSo_4.6H_2O$ solution can be injected through line 27 to line 28. Intermediate temperature sulfiding zone 30 is operated at a temperature higher than the temperature in low temperature sulfiding zone 26. The sulfiding reaction is continued in zone 30 and ammonium oxythiomolybdate or ammonium oxythiotungstate is converted to molybdenum oxysulfide and/or sulfides and oxides or tungsten oxysulfide and/or sulfides and oxides, thereby freeing ammonia.

An effluent stream from intermediate temperature sulfiding zone 30 is passed through line 32 to ammonia separator or flash chamber 36. In flash separator 36, cooling and depressurizing of the effluent stream from line 32 causes vaporization of ammonia and hydrogen sulfide. Flash conditions are established so that only a minor amount of water is vaporized and sufficent water remains in the flash residue to maintain an easily pumpable slurry suspension of the catalyst.

Flash separator residue is removed from flash separator 36 through lines 37 and 38. If desired, the Group VIII metal can be added to line 38 through line 39, e.g., in the form of aqueous $NiSO_4.6H_2O$ solution. The flash residue in line 38 is essentially free of oil since no oil was introduced to low temperature sulfiding zone 26 or intermediate temperature sulfiding zone 30. Feed oil is introduced to the system for the first time through line 40 and is admixed with a hydrogen-hydrogen sulfide mixture entering through lines 42 and 44. The flash residue in line 38 together with feed oil, hydrogen and hydrogen sulfide is introduced through line 46 to high temperature sulfiding zone 48.

High temperature sulfiding zone 48 is operated at a temperature higher than the temperature in intermediate temperature sulfiding zone 30. In high temperature sulfiding zone 48, molybdenum oxysulfide or tungsten oxysulfide is converted to highly active molybdenum disulfide or tungsten disulfide. The preparation of the catalyst is now complete. Some hydroprocessing of the feed oil entering through line 40 is performed in high temperature sulfiding zone 48.

An effluent stream from high temperature sulfiding zone 48 is passed through lines 50 and 52 to hydroprocessing reactor 56. Hydroprocessing reactor is operated at a temperature higher than the temperature in high temperature sulfiding zone 48. If the slurry catalyst bypassed high temperature reactor 48 enroute to hydroprocessing reactor 56, under the influence of the high temperature of hydroprocessor reactor 56 the water in hydroprocessing reactor 56 would oxygenate the catalyst, competing with the sulfiding reaction and causing the catalyst to be converted into a sulfur-deficient high coke producer. When high temperature sulfiding zone 48 precedes the hydroprocessing reactor, the relatively lower temperature in zone 48 allows the sulfiding reaction to prevail over any competing oxidation reaction in the presence of water to complete the sulfiding of the catalyst and render it stable at the higher temperature of hydroprocessing zone 56. With certain oil feedstocks, the relatively lower temperature of high temperature sulfiding zone 48 will suffice for performing the oil hydroprocessing reactions, in which case hydroprocessing reactor 56 can be dispensed with. However, most feed oils will require the relatively higher temperature and residence time in hydroprocessing reactor 56 to complete the oil hydrotreating reactions.

An effluent stream is removed from hydroprocessing reactor 56 through line 60 and passed to flash separator 62. An overhead gaseous stream is removed from separator 62 through line 64 and is passed through a scrubber 66 wherein impurities such as ammonia and light hydrocarbons are removed and discharged from the system through line 68. A stream of purified hydrogen and hydrogen sulfide is recycled through lines 70, 44 and 46 to high temperature sulfiding reactor 48.

A bottoms oil is removed from separator 62 through line 72 and passed to atmospheric distillation tower 74. As indicated in the figure, various fractions are separated in tower 74 including a refinery gas stream, a $C_3/C_4$ light hydrocarbon stream, a naphtha stream, a No. 2 fuel oil and a vacuum charge oil stream for passage to a vacuum distillation tower, not shown.

A concentrated catalyst slurry stream is removed from the bottom of tower 74 through line 76. Some of this catalyst-containing stream can be recycled to hydroprocessing reactor 56 through line 58, if desired. Most, or all, of the heavy catalytic slurry in line 76 is passed to deasphalting chamber 78 from which a deasphalted oil is removed through line 81. A highly concentrated deactivated catalyst stream is removed from deasphalting chamber 78 through line 80 and passed to catalyst generation zone 82.

The catalyst entering regeneration zone 82 comprises molybdenum sulfide or tungsten sulfide together with impurity metals acquired from the feed oil. The impurity metals comprise primarily vanadium sulfide and nickel sulfide. In regeneration chamber 82 all of these metal sulfides are oxidized by combustion to the oxide state. The metal oxides are then passed through line 84 to catalyst reclamation zone 86. In reclamation zone 86 molybdenum oxide or tungsten oxide is separated from impurity metals including vanadium oxide and nickel oxide by any suitable means. Non-dissolved impurity metals including vanadium and nickel are discharged from the system through line 88 while purified and concentrated molybdenum oxide or tungsten oxide is passed through line 16 for mixing with make-up molybdenum oxide or tungsten oxide entering through line 10, to repeat the cycle.

The catalyst promotion with Group VIII Metal method of this invention is not limited to the particular method for preparing the basic Group VIB catalyst described above. Therefore, the present invention can be further illustrated by the catalyst preparation method of FIG. 2. FIG. 2 shows first catalyst precursor reactor 100 to which a slurry of solid $MoO_3$ in water is changed through line 102 and to which aqueous ammonia is charged through line 104. Reactor 100 is operated at a temperature of 150° F. and molydenum is dissolved to form soluble ammonium molybdates. The stream of soluble ammonium molybdates is passed through line 108 to second catalyst precursor reactor 106.

A stream of hydrogen sulfide in line 110 is charged to reactor 106 and reacted with the ammonium molybdates therein at a temperature of 150° F. to accomplish some sulfiding to convert some soluble ammonium molybdate to a slurry comprising ammonium molybdenum oxysulfide, $(NH_4)_xMoO_ySz$. The slurry comprising ammonium molybdena oxysulfide is removed from second catalyst precursor reactor 106 and passed through line 112 to low temperature sulfiding reactor 114. Feed oil in line 116 and a hydrogen-hydrogen sulfide mixture in line 118 are also charged to low temperature sulfiding reactor 114.

A solution of a Group VIII metal salt, such as $NiSO_4.6H_2O$, is passed to low temperature reactor 114 through line 120. If desired, the Group VIII metal salt can be charged instead or also to intermediate temperature sulfiding reactor 122 through line 124. The temperature in low temperature sulfiding reactor 114 is 180° F.

The oil slurry effluent from reactor 114 is passed to intermediate temperature sulfiding reactor 122 through line 126. As indicated above, if desired, the nickel salt solution can be changed to intermediate temperature sulfiding reactor 122 through line 124 instead of or in addition to to low temperature sulfiding reactor 114. The temperature in reactor 122 is 450° F.

The oil slurry effluent fom reactor 122 is passed through line 128 to high temperature sulfiding reactor 130. Reactor 130 is operated at a temperature of 680° F. The preparation of the Group VIII metal-promoted molybdenum sulfide catalyst is essentially completed in high temperature sulfiding reactor 130.

A slurry containing Group VIII metal-promoted molybdenum sulfide catalyst in feed oil is passed through line 132 to hydroprocessing reactor 134. Reactor 134 is operated at a temperature of 810° F. to catalytically hydrotreat the feed oil. A product effluent stream is removed from reactor 134 through line 136 and subsequently treated in a process which is similar to the stream passing through line 60 in FIG. 1.

We claim:

1. A process for preparing a dispersed Group VIB metal sulfide catalyst promoted with a Group VIII metal for hydrocarbon oil hydroprocessing comprising preparing an aqueous solution of an oxygen-containing ammonium salt of a Group VI metal, sulfiding said ammonium salt in a plurality of distinct sulfiding steps at progressively increasing temperatures including relatively low and relatively high temperature sulfiding steps, wherein said relatively low temperature is below about 350° F. and said relatively high temperature is above about 500° F. to convert said oxygen-containing ammonium salt of Group VIB metal to Group VIB metal sulfide, adding a Group VIII metal compound to at least one of said sulfiding steps and performing at least a relatively high temperature sulfiding step in the presence of feed hydrocarbon oil.

2. The process of claim 1 wherein said relatively low and relatively high temperature sulfiding steps are performed in the presence of feed oil.

3. The process of claim 1 wherein at least one relatively low temperature sulfiding step is operated in the absence of feed oil.

4. The process of claim 1 wherein said Group VIB metal is molybdenum.

5. The process of claim 1 wherein said Group VIB metal is tungsten.

6. The process of claim 1 wherein said Group VIII metal is nickel.

7. The process of claim 1 wherein said Group VIII metal is cobalt.

8. The process of claim 1 wherein the weight ratio of Group VIII metal to Group VI metal is 0.001 to 0.75.

9. The process of claim 1 wherein the weight ratio of Group VIII metal to Group VI metal is 0.01 to 0.30.

10. The process of claim 1 wherein the weight ratio of Group VIII metal to Group VI metal is 0.08 to 0.20.

11. The process of claim 1 including passing the effluent stream from said relatively high temperature sulfiding including the dispersed catalyst to a hydrocarbon oil hydroprocessing zone.

12. The process of claim 1 wherein at least one relatively low temperature sulfiding step is performed without feed oil, at least one relatively high temperature sulfiding step is operated in the presence of feed oil and ammonia is separated prior to said at least one relatively high temperature sulfiding step.

13. The process of claim 12 wherein said Group VIII metal compound is added to said relatively high temperature sulfiding step and after said ammonia separation step.

14. A process for preparing a dispersed Group VIB metal sulfide catalyst promoted with a Group VIII metal for hydrocarbon oil hydroprocessing comprising sulfiding an aqueous dispersion of a thiosubstituted ammonium salt of Group VIB metal in the presence of a Group VIII metal compound, wherein said sulfiding occurs in a plurality of distinct sulfiding steps at progressively increasing temperatures including relatively low and relatively high temperature steps, wherein said relatively low temperature is below about 350° F. and said relatively high temperature is above about 500° F.

15. The process of claim 14 wherein said sulfiding steps are performed in the presence of feed oil.

16. The process of claim 14 wherein at least one relatively low temperature sulfiding step is performed in the absence of feed oil.

17. The process of claim 14 wherein ammonia is separated between sulfiding steps.

18. The process of claim 13 wherein said salt is a thiosubstituted ammonium molybdenum oxide.

19. The process of claim 13 wherein said Group VIB metal is molybdenum.

20. The process of claim 13 wherein said Group VIB metal is tungsten.

21. The process of claim 13 wherein said Group VIII metal is nickel.

22. The process of claim 13 wherein said Group VIII metal is cobalt.

23. The process of claim 13 wherein the weight ratio of Group VIII metal to Group VIB metal is 0.001 to 0.75.

24. The process of claim 13 wherein the weight ratio of Group VIII metal to Group VIB metal is 0.01 to 0.30.

25. The process of claim 13 wherein the weight ratio of Group III metal to Group VIB metal is 0.08 to 0.20.

26. The process of claim 13 including the additional step of passing dispersed sulfide catalyst and feed hydrocarbon oil to a hydrocarbon oil hydroprocessing zone.

27. The process of claim 13 wherein said Group VIII metal compound is an aqueous solution of a Group VIII metal salt.

28. The process of claim 13 wherein said Group VIII metal compound is an organometallic compound.

29. The process of claim 13 wherein said salt is an ammonium oxymonothiosubstituted salt.

30. The process of claim 13 wherein said salt is an ammonium oxydithiosubstituted salt.

31. The process of claim 13 wherein said salt is an ammonium oxytrisubstituted salt.

32. The process of claim 13 wherein salt is an ammonium oxytetrasubstituted salt.

* * * * *

UNITED STATES PATENT AND TRADEMARK OFFICE

CERTIFICATE OF CORRECTION

PATENT NO. : 4,824,821

DATED : April 25, 1989

INVENTOR(S) : Jaime Lopez et al

It is certified that error appears in the above-identified patent and that said Letters Patent is hereby corrected as shown below:

Claim 25, Col.18, line 27, "Group III" should read --Group VIII--

Signed and Sealed this

Twenty-seventh Day of February, 1990

*Attest:*

JEFFREY M. SAMUELS

*Attesting Officer*

*Acting Commissioner of Patents and Trademarks*